US011424530B2

(12) United States Patent
Shi et al.

(10) Patent No.: US 11,424,530 B2
(45) Date of Patent: Aug. 23, 2022

(54) COMMUNICATION ANTENNA AND RADIATION UNIT THEREOF

(71) Applicant: TONGYU COMMUNICATION INC., Zhongshan (CN)

(72) Inventors: Lei Shi, Zhongshan (CN); Cailong Yue, Zhongshan (CN); Tushuang Wei, Zhongshan (CN); Jin Yang, Zhongshan (CN); Wen Ding, Zhongshan (CN); Wei Zhao, Zhongshan (CN); Mulin Liu, Zhongshan (CN); Cong Fu, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 0 days.

(21) Appl. No.: 17/053,203

(22) PCT Filed: Mar. 1, 2019

(86) PCT No.: PCT/CN2019/076768
§ 371 (c)(1),
(2) Date: Nov. 5, 2020

(87) PCT Pub. No.: WO2020/151049
PCT Pub. Date: Jul. 30, 2020

(65) Prior Publication Data

US 2021/0135347 A1 May 6, 2021

(30) Foreign Application Priority Data

Jan. 23, 2019 (CN) ..... 201910064099.4

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/246* (2013.01); *H01Q 1/50* (2013.01); *H01Q 19/17* (2013.01);
(Continued)

(58) Field of Classification Search
CPC .. H01Q 1/38; H01Q 1/24; H01Q 1/50; H01Q 19/17; H01Q 21/00; H01Q 21/30
(Continued)

(56) References Cited

U.S. PATENT DOCUMENTS

| | | | | |
|---|---|---|---|---|
| 6,771,226 | B1 | 8/2004 | Dujmovic | |
| 2005/0024282 | A1 | 2/2005 | Apostolos | |
| 2016/0164190 | A1* | 6/2016 | Daurer | H01Q 13/106 343/770 |

FOREIGN PATENT DOCUMENTS

CN 105393406 A 3/2016

OTHER PUBLICATIONS

Oct. 8, 2019 Search Report issued in International Patent Application No. PCT/CN2019/076768.

* cited by examiner

*Primary Examiner* — Andrea Lindgren Baltzell
(74) *Attorney, Agent, or Firm* — Oliff PLC

(57) ABSTRACT

A communication antenna and radiation unit thereof with tapered clearance slots for transceiving radiation signals disposed at four corners of the radiation unit. The slots form groups and are arranged and fed by two feeding units. A middle portion of the radiation unit is a flat central platform. Peripheries of the radiation unit are turned up to form folded edges. The communication antenna includes a reflecting plate and a radiation unit operating at a low frequency. The central platform has a high-frequency radiation element. The radiation unit has a small aperture and is lightweight, so the antenna size is reduced, and a radiation performance indi-
(Continued)

cator can be ensured. The radiation unit is applied to a multi-frequency antenna, has little effect on a high-frequency oscillator, and is especially suitable for a multi-frequency base station antenna with a low-frequency unit and a high-frequency unit forming an array in a nested manner.

10 Claims, 3 Drawing Sheets

(51) Int. Cl.
*H01Q 1/50* (2006.01)
*H01Q 19/17* (2006.01)
*H01Q 21/00* (2006.01)
*H01Q 21/30* (2006.01)

(52) U.S. Cl.
CPC ..... *H01Q 21/0075* (2013.01); *H01Q 21/30* (2013.01)

(58) Field of Classification Search
USPC ..... 343/700 MS
See application file for complete search history.

COMMUNICATION ANTENNA AND RADIATION UNIT THEREOF

BACKGROUND

Technical Field

The present invention relates to a communication antenna, and in particular, to a bowl-shaped small-aperture radiation unit and a communication antenna using the radiation unit.

Related Art

A radiation unit is the main part of an antenna, which can radiate and receive an electromagnetic wave, thereby implementing wireless communication. A dual-polarization radiation unit can realize space diversity, and also can work in a duplex transceiving mode, which greatly reduces a number of antennas and occupation space. A size of an aperture and a height of the radiation unit directly affect a size of the antenna. At present, the customer has increasingly higher requirements for miniaturization of the antenna. However, the existing radiation unit generally has a large aperture and a large height, which leads to an excessively large antenna size, and the requirements of the customer cannot be satisfied. Therefore, how to reduce the aperture of the radiation unit is an urgent problem to be solved at present.

A Vivaldi antenna is an improved form of a linear tapered slot antenna, which is an exponentially tapered end-fire travelling wave antenna and is generally made by using the printed circuit technology. The structure gradually changes from a relatively narrow metal slot line to a relatively wide metal slot line, and the gradually changing form changes according to an exponential law, so that a horn-shaped opening is formed at a signal-transmitting end for receiving or transmitting electromagnetic waves. Different parts of the antenna slot line respectively receive and transmit electromagnetic wave signals of different frequencies.

SUMMARY

The technical problem to be resolved in the present invention is to overcome the problem of an excessively large antenna size because the existing antenna radiation unit has a relatively large aperture and occupies a lot of space inside the antenna, so that a small-aperture radiation unit and a communication antenna using the radiation unit are provided. The technical solutions used in the present invention to resolve the foregoing technical problem are as follows. A radiation unit of a communication antenna is provided. Tapered clearance slots for transceiving radiation signals are disposed at four corners of the radiation unit. Two tapered clearance slots that are diagonally distributed form a group, and two groups of tapered clearance slots are orthogonally arranged and respectively fed by two feeding units. A middle portion of the radiation unit is a flat central platform, and peripheries of the radiation unit are turned up toward a same side to form folded edges surrounding the central platform.

Two adjacent folded edges are fixed by a dielectric slab located at an opening of the tapered clearance slot.

The tapered clearance slot includes a slot hole on the central platform, a transition slot line connected to the slot hole, and a tapered slot line extending outward from the transition slot line and with the clearance gradually increasing.

A window of a hollow structure is provided on the peripheries of the radiation unit surrounding the central platform.

A part of the window of the hollow structure located between the adjacent tapered clearance slots causes two arm structures extending outward to be respectively formed at the four corners of the radiation unit, a tapered clearance slot existing between the two arm structures.

A part of the window of the hollow structure located on the folded edges on the peripheries of the radiation unit causes a width of a middle portion of the folded edges to be less than widths of two sides. The peripheries of the central platform are provided with folding sheets that are folded in a same direction as the folded edges.

An upper surface and a lower surface of the central platform are respectively provided with a feeding PCB, the feeding PCBs on the two surfaces respectively feeding two groups of orthogonal tapered clearance slots.

One surface of the central platform is provided with a matching circuit PCB.

A communication antenna having the radiation unit includes a reflecting plate and the radiation unit disposed on the reflecting plate and operating at a low frequency, a central platform of the radiation unit being provided with a high-frequency radiation element.

The reflecting plate is provided with a low-frequency array composed of a plurality of radiation units and a high-frequency array composed of a plurality of high-frequency radiation elements, where some or all of the high-frequency radiation elements are correspondingly disposed on the central platform of the radiation unit.

The beneficial effects of the present invention are described below. The radiation unit uses the Vivaldi antenna principle to fold a part of the area in a horizontal direction through deformation, so that the occupied area in the horizontal direction is reduced, and a small-aperture bowl-shaped radiation unit is formed. Since the bowl-shaped radiation unit occupies less space, a size of the antenna can be reduced under the condition that the performance of the antenna remains unchanged.

A middle portion of the radiation unit is a central platform. When the radiation unit is working at a low frequency, a high-frequency radiation element can be additionally mounted on the central platform to implement mounting of the low-frequency unit and the high-frequency unit in a nested and superimposed manner, thereby further reducing the antenna size.

In addition, a dielectric slab is disposed at an opening of the tapered clearance slot to fix adjacent folded edges. When the structural stability of the radiation unit is strengthened, the dielectric slab can play a role in media loading and ensure radiation performance.

The bowl-shaped radiation unit of the present invention reduces the aperture of the radiation unit to only 0.3-0.4 times of a working wavelength.

On this basis, a hollow structure is disposed on the peripheries of the radiation unit surrounding the central platform, and a thinner part is reserved, which can weaken the coupling between the high-frequency unit and the low-frequency unit and can reduce the weight of the radiation unit.

Further, folding sheets are disposed on the peripheries of the central platform, which can be used as the boundary of the central high-frequency unit to adjust a beam width and cross polarization of the high-frequency radiation element.

Therefore, in the present invention, the small-aperture bowl-shaped radiation unit has main features of a small aperture and a light weight, which can significantly reduce the size of the antenna, and a radiation performance indicator of the antenna can be ensured, thereby meeting requirements of customers. The radiation unit is applied to a multi-frequency antenna, has little effect on the high-frequency radiation element, and is especially suitable for a multi-frequency base station antenna with a low-frequency unit and a high-frequency unit forming an array in a nested manner.

Figure 1:
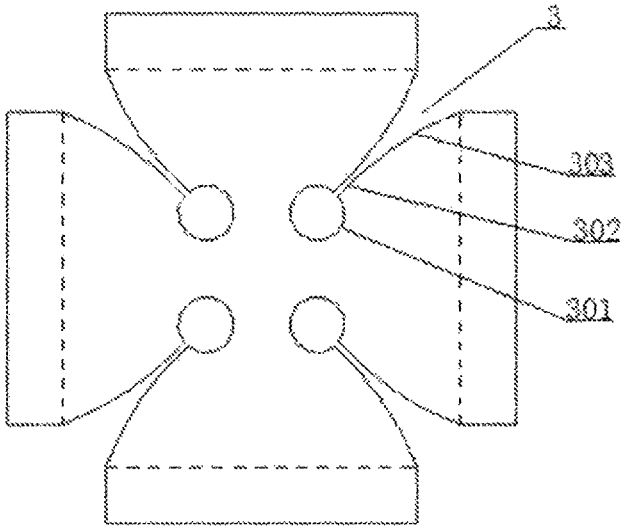
FIG. 1 is a schematic diagram based on a Vivaldi antenna.

Reference numerals: 1. Central platform, 2. Folded edge, 3. Tapered clearance slot, 301. Slot hole, 302. Transition slot line, 303. Tapered slot line, 4. Feeding unit, 5. Dielectric slab, 6. Window, 7. Arm-shaped structure, 8. Folding sheet, 9. Matching circuit PCB, 10. Reflecting plate, 11. High-frequency radiation element.

H1, H2, H3, H4, H5, H6, H7, H8, H9, and H10 are high-frequency radiation elements; L1, L2, L3, L4, L5, and L6 are radiation units; B1, B2, B3, B4, B5, B6, B7, B8, B9, B10, B11, B12, B13, B14, B15, B16, B17, B18, B19, and B20 are high-frequency radiation elements; and D1, D2, D3, D4, D5, and D6 are radiation units.

DETAILED DESCRIPTION

Implementations of the present invention will be described in detail with reference to embodiments.

A radiation unit of the present invention applies the Vivaldi antenna principle. As shown in FIG. 1, tapered clearance slots 3 for transceiving radiation signals are disposed at four corners of the radiation unit, two tapered clearance slots that are diagonally distributed form a group, and two groups of tapered clearance slots are orthogonally arranged. By folding along the dashed line in the figure, the occupied horizontal area can be reduced, so that an aperture of the radiation unit can be reduced, which is 0.3-0.4 times of a working wavelength.

Figure 2:
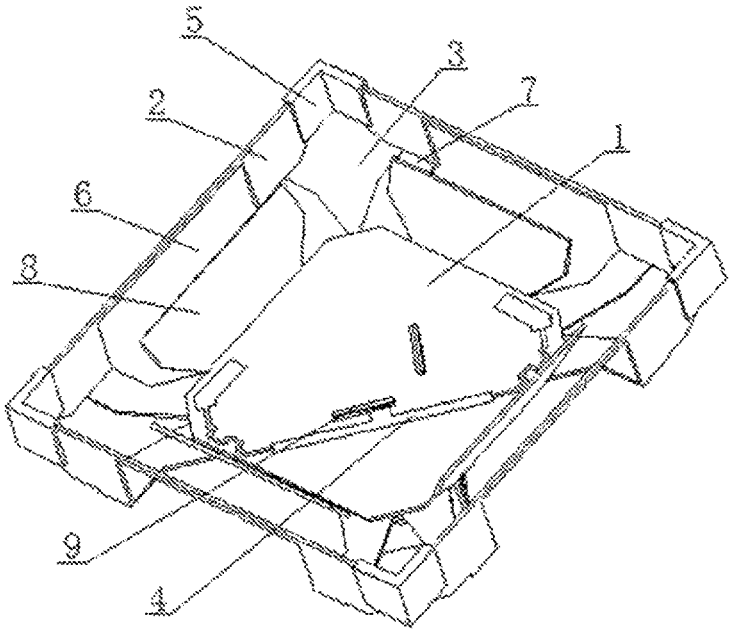
FIG. 2 is a schematic diagram of a front surface of a radiation unit according to the present invention.

FIG. 2 is the radiation unit obtained by folding and deforming along the dashed line in FIG. 1. The radiation unit has a bowl-shaped structure with a flat central platform 1 in a middle portion. After peripheral edges are folded, folded edges 2 turned up toward a same side are formed on the peripheries of the radiation unit, and there is a tapered clearance slot 3 between two adjacent folded edges 2.

Two groups of orthogonally arranged tapered clearance slots are fed by two feeding units 4, respectively. An upper surface and a lower surface of the central platform 1 are respectively provided with a feeding PCB, the feeding PCB being provided with a feeding unit 4 in the form of a microstrip line, and the feeding PCBs on two surfaces respectively feeding two groups of orthogonal tapered clearance slots, to avoid line crossing. The tapered clearance slot 3 applies the Vivaldi antenna principle, and includes a slot hole 301 on the central platform 1, a transition slot line 302 connected to the slot hole 301, and a tapered slot line 303 extending outward from the transition slot line 302 and with the clearance gradually increasing. A feeding point of the feeding unit is located near the transition slot line 302. By changing the shape and size of the slot hole 301 at the rear of the feeding point and an opening angle of the tapered slot line 303 in the front part, the clearance antenna input impedance can be mutually adjusted, thereby showing the bandwidth. Further, by changing a length and a width of an open-circuit branch of the feeding unit 4 on the feeding PCB, the standing-wave effect can be adjusted. A thickness of the feeding PCB is increased, so that the bandwidth can be further increased. For the specific size of the tapered clearance slot and the feeding line form, reference may be made to the Vivaldi antenna principle, and details are not described in this specification.

Figure 3:
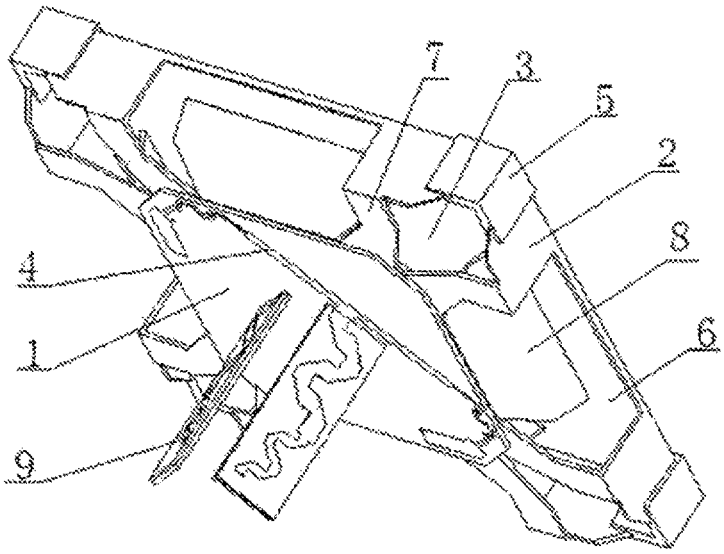
FIG. 3 is a schematic diagram of a back surface of a radiation unit according to the present invention.
Figure 4:
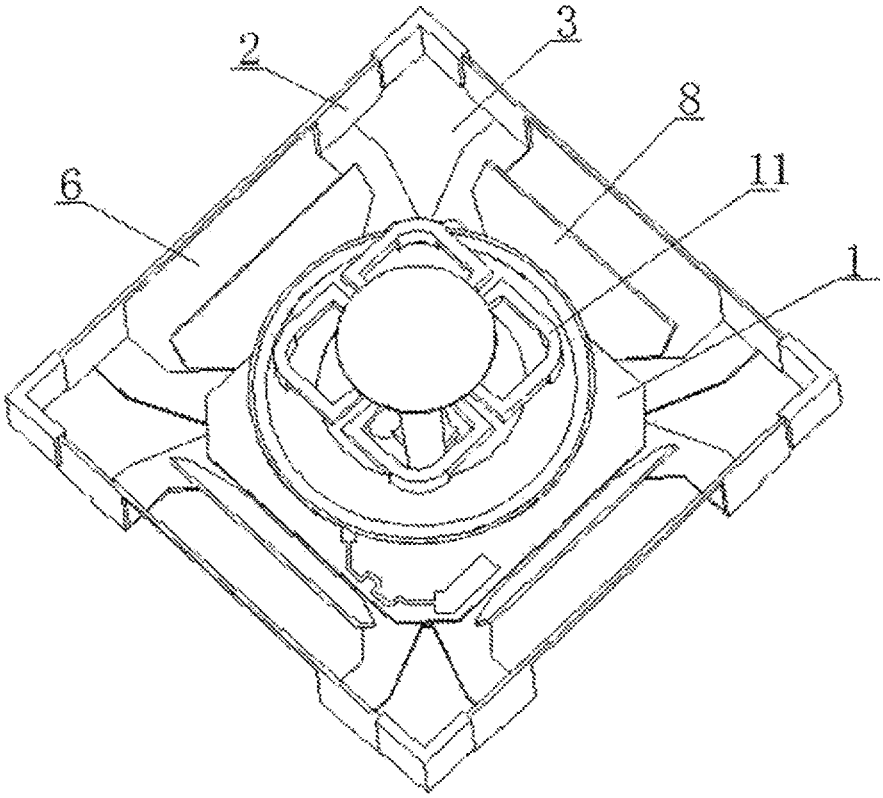
FIG. 4 is a schematic diagram of an embodiment in which a high-frequency radiation element is disposed on a radiation unit according to the present invention.

As shown in FIG. 2 to FIG. 4, openings of the tapered clearance slots 3 at four corners of the radiation unit are all provided with dielectric slabs 5. The dielectric sheets 5 are provided with a bayonet, and adjacent folded edges 2 are fixed by the bayonet of the dielectric slab 5, to maintain a stable structure of the radiation unit. The dielectric slab 5 has the function of medium loading while ensuring the clearance size. By selecting different dielectric materials and adjusting the dielectric constant of the medium, input impedance of the radiation unit changes slowly with the change of frequency, thereby expanding the bandwidth and adjusting standing waves.

As shown in FIG. 4, the radiation unit of the present invention is capable of working at a low frequency, and a high-frequency radiation element 11 can be additionally disposed on the central platform 1 to implement mounting of the high-frequency unit and the low-frequency unit in a nested and superimposed manner, thereby reducing the antenna size.

As shown in FIGS. 2 and 3, one surface of the central platform 1 is provided with two matching circuit PCBs 9, and a microstrip line is disposed on the matching circuit PCB 9, which can meet the feeding requirements of the feeding unit 4 and the high-frequency radiation element 11. By changing the length and width of the transmission line on the matching circuit PCB 9, the standing wave of the radiation unit can be further adjusted.

As shown in FIG. 2 to FIG. 4, the radiation unit can be hollowed out by using the metal on the peripheries, and a window 6 of a hollow structure is disposed on the radiation unit surrounding the central platform 1. The part remaining after hollowing out can be as thin as possible, which can weaken the coupling between high and low frequencies, and reduce the weight of the radiation unit.

The window 6 of the hollow structure can be disposed both on a plane part and folded edges of the radiation unit. A part of the window 6 on the plane of the radiation unit is located between the adjacent tapered clearance slots. The hollow structure causes two arm structures 7 extending outward to be respectively formed at the four corners of the radiation unit, a tapered clearance slot 3 existing between the two arm structures. A part of the window 6 of the hollow structure located on the folded edges 2 on the peripheries of the radiation unit causes a width of a middle portion of the folded edges to be less than widths of two sides, and only a thinner part remains at the middle edge of the folded edge 2 to connect two ends thereof.

Further, as shown in FIG. 2 to FIG. 4, the peripheries of the central platform 1 are provided with folding sheets 8 that are folded in a same direction as the folded edges 2. Four folding sheets 8 on the peripheries surround the central platform 1 and serve as the boundary of the central high-frequency unit of the bowl-shaped radiation unit, to adjust the wave width and cross polarization of the high-frequency unit. The folding sheet 8 shown can be formed when the peripheries of the radiation unit are hollowed out. For example, a part of the peripheries of the radiation unit is cut and folded upward, the folded part forms the folding sheet 8, and the left gap forms a hollow window 6.

During application to the communication antenna, the radiation unit of the present invention can be mounted in a nested manner through matching with a high-frequency radiation element. The radiation unit is mounted on the reflecting plate of the communication antenna and works at a low frequency, and the high-frequency radiation element is disposed on the central platform of the radiation unit in a nested manner.

A plurality of radiation units and a plurality of high-frequency radiation elements can form different arrays on the reflecting plate, and communication antennas with different performances can be obtained by forming arrays in different arraying modes. According to different specific arraying modes, some or all of the high-frequency radiation elements can be correspondingly disposed on the central platform of the radiation unit.

Figure 5:
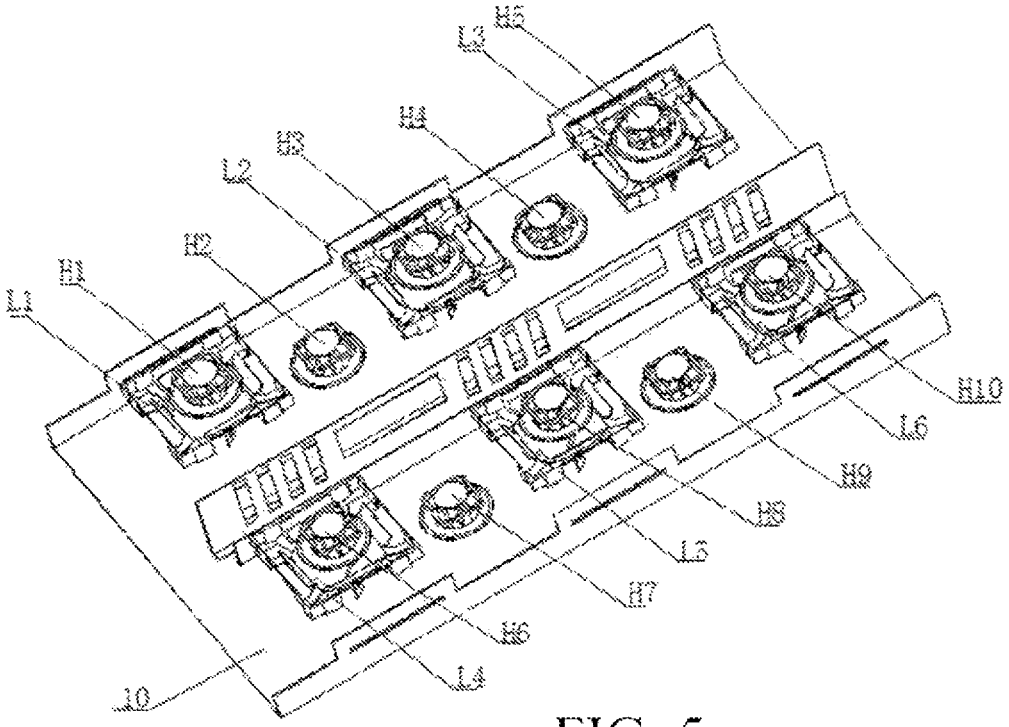
FIG. 5 shows a first embodiment of a multi-frequency bandwidth base station antenna using a radiation unit according to the present invention.

FIG. 5 shows an embodiment of a multi-frequency bandwidth base station antenna using a radiation unit according to the present invention, which is a multi-frequency dual-column coaxial base station antenna. H1, H2, H3, H4, H5, H6, H7, H8, H9, and H10 are high-frequency radiation elements, and a frequency range is 1710 MHz to 2690 MHz. L1, L2, L3, L4, L5, and L6 serve as radiation units operating at low frequencies, and a frequency range is 698 MHz to 960 MHz. High-frequency radiation elements 1-11, H3, H5, H6, H8, and H10 are nested in the radiation unit to reduce the occupied space, and other high-frequency radiation elements are directly mounted on the reflecting plate.

Because the aperture size of the radiation unit of the present invention is much less than that of the existing low-frequency unit, and some high-frequency units are nested in the low-frequency unit, a width of the multi-frequency antenna A is only 466 mm, which can meet the performance index of a coaxial dual-column multi-frequency base station antenna.

Figure 6:
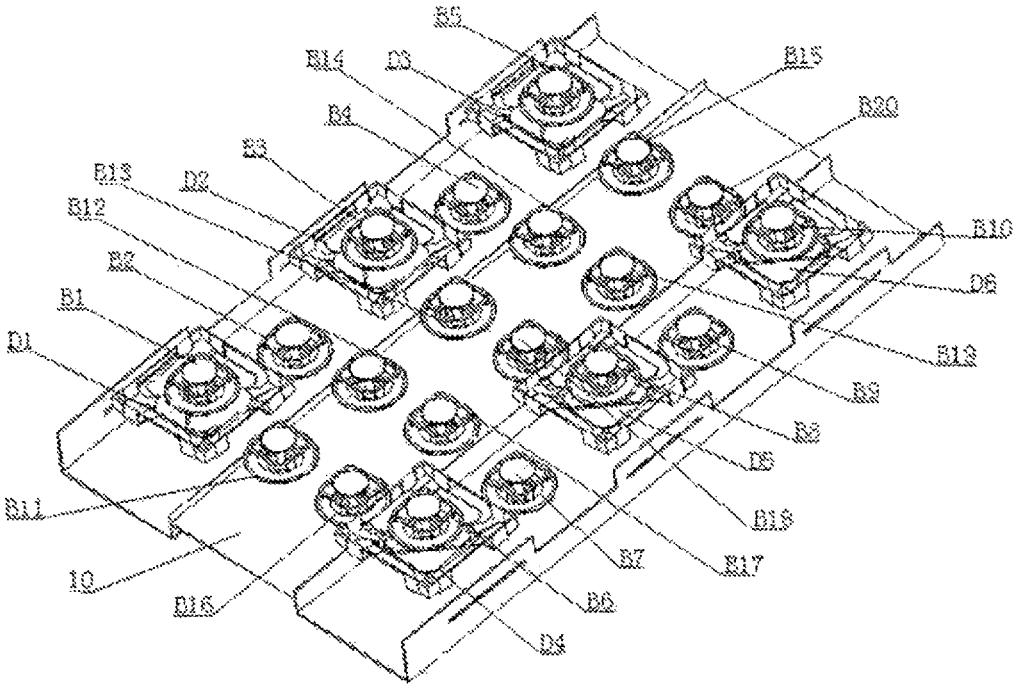
FIG. 6 shows a second embodiment of a multi-frequency bandwidth base station antenna using a radiation unit according to the present invention.

FIG. 6 is another embodiment of a multi-frequency bandwidth base station antenna using the radiation unit according to the present invention. There are four high frequency bands of the antenna, which are arrayed in four columns side by side. The frequency range is 1710 MHz to 2690 MHz, and the low frequency is a dual frequency. The frequency range is 698 MHz to 960 MHz, and the high-frequency unit and the low-frequency unit form an array in a nested manner. B1, B2, B3, B4, B5, B6, B7, B8, B9, B10, B11, B12, B13, B14, B15, B16, B17, B18, B19, and B20 are high-frequency radiation elements, D1, D2, D3, D4, D5, and D6 are radiation units operating at low frequencies. B1, B3, B5, B6, B8, and B10 are nested in D1, D2, D3, D4, D5, and D6, respectively. The space occupied by the radiation unit greatly reduces the width of the antenna to only 476 mm.

The multi-frequency base station antenna adopting the novel small-aperture bowl-shaped radiation unit disclosed in the present invention can significantly reduce the size of the antenna, and can meet the performance indicator of the customer, which is especially suitable for the multi-frequency base station antenna with the low-frequency unit and the high-frequency unit forming an array in a nested manner.

What is claimed is:

1. A radiation unit of a communication antenna, the radiation unit comprising two feeding units;

tapered clearance slots for transceiving radiation signals at four corners of the radiation unit, wherein each two of the tapered clearance slots that are diagonally distributed form a group, which results in two groups of the tapered clearance slots that are orthogonal, and each of the two groups is separately fed by a respective one of the two feeding units;

a middle portion that is a flat central platform; and peripheries that are turned up toward a same side to form folded edges surrounding the central platform.

2. The radiation unit according to claim 1, wherein two of the folded edges that are adjacent are fixed by a dielectric slab at an opening of one of the tapered clearance slots that is between the two of the folded edges.

3. The radiation unit according to claim 1, wherein a window of a hollow structure is on the peripheries of the radiation unit surrounding the central platform.

4. The radiation unit according to claim 3, wherein a part of the window of the hollow structure between the adjacent tapered clearance slots causes two arm structures extending outward to be respectively formed at the four corners of the radiation unit, and one of the tapered clearance slots is between the two arm structures.

5. The radiation unit according to claim 3, wherein a part of the window of the hollow structure on the folded edges on the peripheries of the radiation unit causes a width of a middle portion of the folded edges to be less than widths of two sides.

6. The radiation unit according to claim 3, wherein the peripheries of the central platform include folding sheets that are folded in a same direction as the folded edges.

7. The radiation unit according to claim 1, further comprising a feeding PCB on an upper surface of the central platform and a feeding PCB on a lower surface of the central platform that respectively feed the two groups of the tapered clearance slots that are orthogonally arranged.

8. The radiation unit according to claim 1, further comprising a matching circuit PCB on one surface of the central platform.

9. A communication antenna comprising:

a reflecting plate, wherein the radiation unit of claim 1 is on the reflecting plate and operates at a low frequency, and a high-frequency radiation element on the central platform of the radiation unit.

10. The communication antenna according to claim 9, further comprising a low-frequency array composed of a plurality of radiation units and a high-frequency array composed of a plurality of high-frequency radiation elements, wherein some or all of the high-frequency radiation elements are on the central platform.

* * * * *